US006746215B2

(12) United States Patent
Tani et al.

(10) Patent No.: US 6,746,215 B2
(45) Date of Patent: Jun. 8, 2004

(54) COMPRESSOR

(75) Inventors: Masao Tani, Tokyo (JP); Fumiaki Sano, Tokyo (JP); Kiyoharu Ikeda, Tokyo (JP); Minoru Ishii, Tokyo (JP); Takeshi Fushiki, Tokyo (JP); Yoshihide Ogawa, Tokyo (JP); Teruhiko Nishiki, Tokyo (JP); Takashi Sebata, Tokyo (JP); Shin Sekiya, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/179,960

(22) Filed: Jun. 26, 2002

(65) Prior Publication Data

US 2003/0086798 A1 May 8, 2003

(30) Foreign Application Priority Data

Nov. 8, 2001 (JP) ..... 2001-343125

(51) Int. Cl.[7] ..... F04B 17/00; F04B 35/00; F04B 39/02

(52) U.S. Cl. ..... 417/366; 417/902; 418/55.6

(58) Field of Search ..... 417/366, 368, 417/372, 902; 418/55.1, 55.5, 55.6, 101, 88, 151

(56) References Cited

U.S. PATENT DOCUMENTS

| | | | | |
|---|---|---|---|---|
| 4,488,855 A | * | 12/1984 | Butterworth et al. | 417/368 |
| 4,755,114 A | * | 7/1988 | Shibayashi et al. | 418/55 |
| 4,836,755 A | * | 6/1989 | Nitsche et al. | 417/368 |
| 5,160,253 A | * | 11/1992 | Okada et al. | 418/55.2 |
| 5,370,513 A | | 12/1994 | Fain | 418/55.6 |
| 5,464,332 A | * | 11/1995 | Beck et al. | 417/368 |
| 5,466,134 A | | 11/1995 | Shaffer et al. | |
| 6,135,739 A | | 10/2000 | Ogawa et al. | 418/55.5 |
| 6,318,982 B1 | * | 11/2001 | Fujii et al. | 418/55.4 |

FOREIGN PATENT DOCUMENTS

| | | |
|---|---|---|
| CN | 1042969 C | 4/1999 |
| EP | 1 002 953 | 5/2000 |
| JP | 3-199692 | 8/1991 |
| JP | 8-86292 | 4/1996 |
| JP | 9-228975 | 9/1997 |

OTHER PUBLICATIONS

Patent Abstracts of Japan, JP 2000–161254, Jun. 13, 2000.

* cited by examiner

*Primary Examiner*—Justine R. Yu
*Assistant Examiner*—Han L Liu
(74) *Attorney, Agent, or Firm*—Oblon, Spivak, McClelland, Maier & Neustadt, P.C.

(57) ABSTRACT

A compressor includes a compression mechanism part for compressing refrigerant sucked from an outside of the hermetic container and discharging compressed refrigerant to a discharge space, an electric motor part composed of a stator and a rotor, facing a first space which is at an opposite side of the discharge space with respect to the compression mechanism part in the hermetic container, for driving the compression mechanism part through a main shaft, a passage at an external circumferential side of the compression mechanism part, for connecting the discharge space with the first space, and a fan provided at an end of the rotor, facing the first space. The refrigerant discharged into the discharge space passes through the passage at the external circumferential side of the compression mechanism part to reach the first space, and passes the fan to be discharged to the outside of the hermetic container.

16 Claims, 8 Drawing Sheets

COMPRESSOR

DETAILED EXPLANATION OF THE INVENTION

1. Technical Field of the Invention

The present invention relates to a refrigerant compressor which has a compression mechanism part and an electric motor part in a hermetic container.

2. Description of the Related Art

FIG. 8 shows a longitudinal sectional view of a conventional scroll compressor disclosed in Japanese Unexamined Patent Publication No. 2000-161254. In FIG. 8, a fixed scroll 1 and a guide frame 15 are shown. The peripheral part of the fixed scroll 1 is fixed to the guide frame 15 by bolts (not shown). From the side of the fixed scroll 1, a suction tube 10*a* is pressed penetrating a hermetic container 10.

A spiral blade 2*b* is provided on a seat 2*a* of an orbiting scroll 2. The form of the spiral blade 2*b* is substantially the same as a spiral blade 1*b* provided on a seat 1*a* of the fixed scroll 1. The spiral blade 1*b* and the spiral blade 2*b* geometrically form a compression chamber 1*d*. A boss part 2*f* being a hollow cylinder is provided at the central part of the surface of the seat 2*a* opposite to the surface where the spiral blade 2*b* exists. The boss part 2*f* is rotatably engaged with an orbiting shaft part 4*b* provided at the upper end of a main shaft 4. A thrust surface 2*d* is formed on the surface of the seat 2*a* opposite to the surface where the spiral blade 2*b* exists. The thrust surface 2*d* is slidably in contact with a thrust bearing 3*a* of a compliant frame 3.

The compliant frame 3 is supported in the radial direction at an upper surface 3*d* and a lower surface 3*e* provided on the external circumferential part of the compliant frame 3, by an upper surface 15*a* and a lower surface 15*b* provided on the internal circumferential part of the guide frame 15. A main bearing 3*c* and a sub-main bearing 3*h* at the center of the compliant frame 3 support the main shaft 4 rotated by a stator 7, in the radial direction. A connection passage 3*s* penetrating along the axial direction from the inside of the thrust bearing 3*a* is also provided. A thrust bearing side opening 2*k* is provided facing an orbiting scroll extraction hole 2*j*.

Although an external circumferential surface 15*g* of the guide frame 15 is adhered to the hermetic container 10 by means of shrinkage fitting or welding, a passage is secured which leads refrigerant gas of high pressure discharged from a discharge port 1*f* of the fixed scroll 1 to a discharge tube 10*b* provided between the compression mechanism part and the electric motor element. This passage is formed by a concave part 15*c* provided at the outer peripheral part of the guide frame 15.

The orbiting shaft 4*b* at the upper end of the main shaft 4 is rotatably engaged with an orbiting bearing 2*c* of the orbiting scroll 2, and a main shaft balancer 4*e* is provided below the orbiting shaft 4*b* by shrinkage fitting. Furthermore, a main shaft part 4*c* which contacts the main bearing 3*c* and the sub-main bearing 3*h* of the compliant frame 3 during rotation is provided below the main shaft balancer 4*e*. Below the main shaft 4, a sub-shaft part 4*d* which is rotatably engaged with a sub-bearing 6*a* of a sub-frame 6 is formed. A rotor 8 is provided by shrinkage fitting between the sub-shaft part 4*d* and the main shaft part 4*c*. A first balancer 8*a* is fixed to the upper end surface of the rotor 8 and a second balancer 8*b* is fixed to the lower end surface of the rotor 8. Static balance and dynamic balance are retained by the three balancers: the first balancer 8*a*, the second balancer 8*b*, and the main shaft balancer 4*e*. An oil pipe 4*f* pressed in the lower end of the main shaft 4 sucks up refrigerating machine oil 10*e* collected in an oil reservoir 10*g* at the bottom of the hermetic container 10.

Now, the basic operation of this conventional scroll compressor will be explained. Sucked low-pressure refrigerant is led from the suction tube 10*a* into the compression chamber 1*d* formed by the spiral blades of the fixed scroll 1 and the orbiting scroll 2. The orbiting scroll 2 driven by the stator 7 decreases the capacity of the compression chamber 1*d* by an eccentric revolution movement. The sucked refrigerant becomes high pressure by this compression process, and is discharged into the hermetic container 10 from the discharge port 1*f* of the fixed scroll 1.

The refrigerating machine oil 10*e* collected in the oil reservoir 10*g* at the bottom of the hermetic container 10 is led by a difference of pressure to an orbiting bearing part 2*g* through a hollow space 4*g* penetrating, along the axial direction, the main shaft 4. The refrigerating machine oil which has become intermediate pressure by a throttle action of the orbiting bearing part 2*g* fills a space 2*h* (boss part space) surrounded by the orbiting scroll 2 and the compliant frame 3. Then, the refrigerating machine oil which has become intermediate pressure is led to a low pressure space via a pressure adjustment valve (not shown) connecting the space 2*h* and a low-pressure atmosphere space, and sucked into the compression chamber 1*d* with the refrigerant gas of low-pressure. By dint of this compression process, the refrigerating machine oil is discharged into the hermetic container 10 from the discharge port 1*f* with high-pressure refrigerant gas.

In the conventional scroll compressor of high-pressure shell type explained above, the refrigerant gas and the refrigerating machine oil are discharged in the state of being mixed as shown in FIG. 9. FIG. 9 illustrates flows of the refrigerant gas and the refrigerant according to the conventional compressor. In FIG. 9, the discharge port 1*f*, the concave part 15*c* provided at the outer peripheral part of the guide frame 15, and the discharge tube 10*b* are shown. The white arrow in FIG. 9 indicates a flow of the refrigerant gas, and the black arrow indicates a flow of the refrigerating machine oil.

The refrigerant gas and the refrigerating machine oil discharged from the discharge port 1*f* go through the concave part 15*c* in the state of mixed, go between the guide frame 15 and the electric motor element, and are finally discharged from the discharge tube 10*b* to the outside of the compressor. However, when they are discharged, rather much refrigerating machine oil is carried out of the compressor with the refrigerant gas. Therefore, there is a problem that pressure loss and deterioration of heat-conducting performance are performed in the unit and seizure of bearings in the compressor occurs because of oil lack, which decreases the reliability of the compressor.

SUMMARY OF THE INVENTION

One of objects of the present invention is to solve the above-mentioned problem in order to obtain a compressor of high reliability. It is another object to obtain a compressor in which the refrigerant gas and the refrigerating machine oil can be separated. Moreover, the present invention aims at obtaining a compressor in which the separated refrigerating machine oil can be returned to the oil reservoir and the mount of refrigerating machine oil carried outside of the compressor can be suppressed.

According to one aspect of the compressor of the present invention, the compressor includes:

a compression mechanism part, included in a hermetic container, for compressing refrigerant sucked from the outside of the hermetic container and discharging compressed refrigerant to a discharge space in the hermetic container;

an electric motor part composed of a stator and a rotor, facing a first space which is at the opposite side, along the axial direction, of the discharge space with respect to the compression mechanism part in the hermetic container, for driving the compression mechanism part through a main shaft;

a discharge tube provided in the hermetic container, being open to the first space;

a passage at the external circumferential side of the compression mechanism part, for connecting the discharge space with the first space; and a fan provided at the end of the rotor, facing the first space, wherein the refrigerant discharged into the discharge space passes through the passage at the external circumferential side of the compression mechanism part to reach the first space, and passes the fan to be discharged to the outside of the hermetic container.

According to another aspect, the compressor of the present invention further includes:

a passage at the external circumferential side of an electric motor, provided at the external circumferential side of the stator, for connecting the first space and the second space which is at the opposite side, along the axial direction, of the first space with respect to the electric motor part; and a passage at the internal circumferential side of the electric motor, provided at between the stator or the rotor and in the rotor, for connecting the first space and the second space, wherein the fan sucks the refrigerant from the internal circumferential side of the fan and discharges the refrigerant to the external circumferential side of the fan, and wherein the refrigerant passes in order of the passage at the external circumferential side of the electric motor, the passage at the internal circumferential side of the electric motor, and the fan, and is discharged to the outside of the hermetic container.

According to another aspect of the compressor of the present invention, the passage at the internal circumferential side of the electric motor is formed as at least one penetration hole, penetrating along the axial direction, provided at the rotor.

According to another aspect of the compressor of the present invention, the passage at the external circumferential side of the electric motor is formed as a notch or a concave part provided at the external circumferential side of the stator.

According to another aspect of the compressor of the present invention, the rotor includes a plate for oil separation at the end of the rotor, facing the second space.

According to another aspect of the compressor of the present invention, the plate includes at least one penetration hole.

According to another aspect of the compressor of the present invention, the plate is fixed by a caulker with a second balancer provided at the end of the rotor, facing the second space.

According to another aspect of the compressor of the present invention, a surface of the fan and an upper surface of a first balancer provided at the end of the rotor, are located on one plane.

According to another aspect of the compressor of the present invention, the fan is fixed by a caulker with the first balancer provided at the end of the rotor, facing the first space.

According to another aspect of the compressor of the present invention, the passage at the external circumferential side of the compression mechanism part is located at the position away from the discharge tube by 90 degrees or greater than 90 degrees of a phase angle along the direction of the circumference.

The above-mentioned and other objects, features, and advantages of the present invention will be made more apparent by reference to the following detailed description when taken in conjunction with the accompanying drawings.

DETAILED DESCRIPTION OF THE PREFERRED EMBODIMENTS

Embodiment 1

Figure 1:
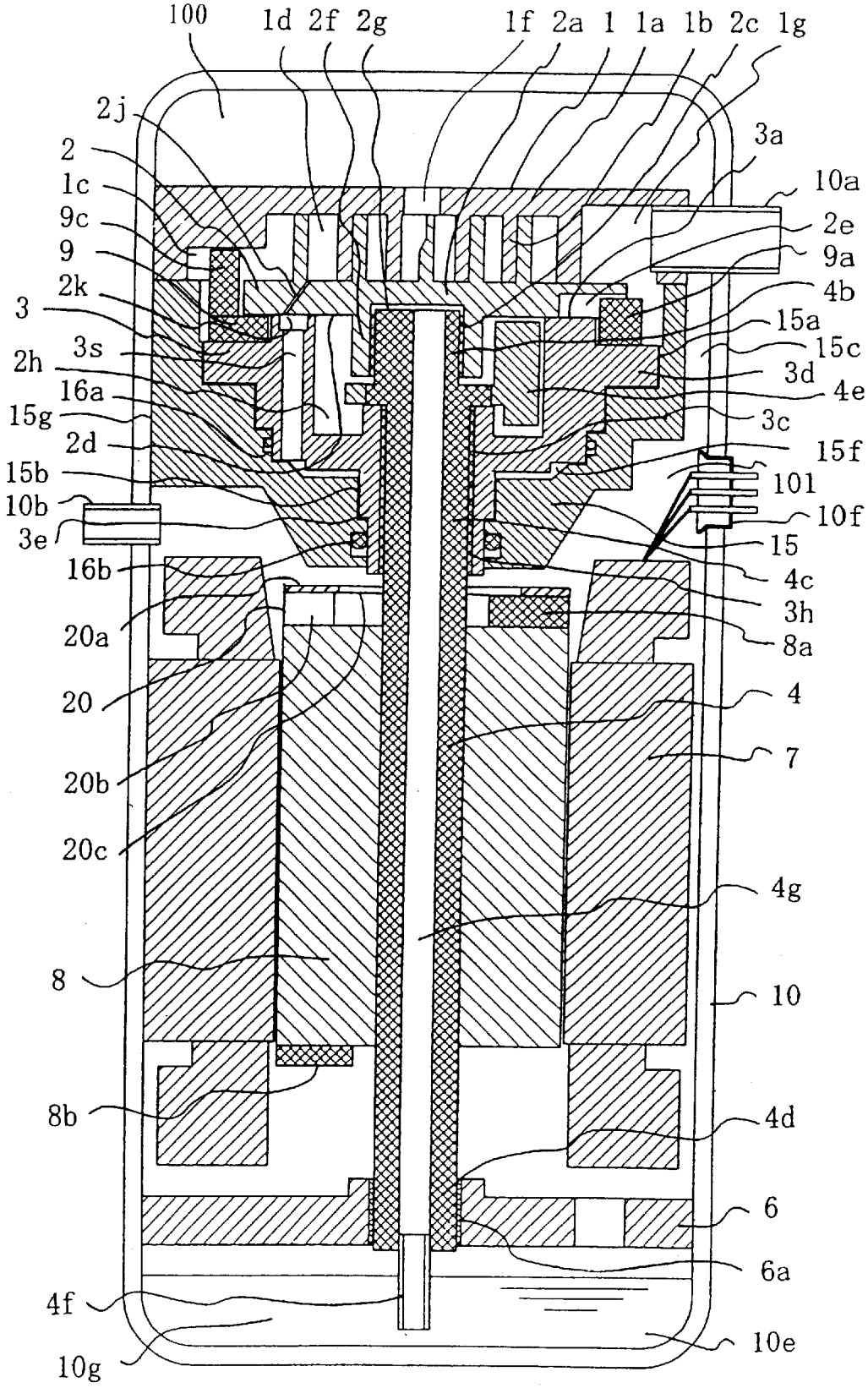
FIG. 1 shows a longitudinal sectional view of a compressor according to Embodiment 1 of the present invention.
Figure 2:
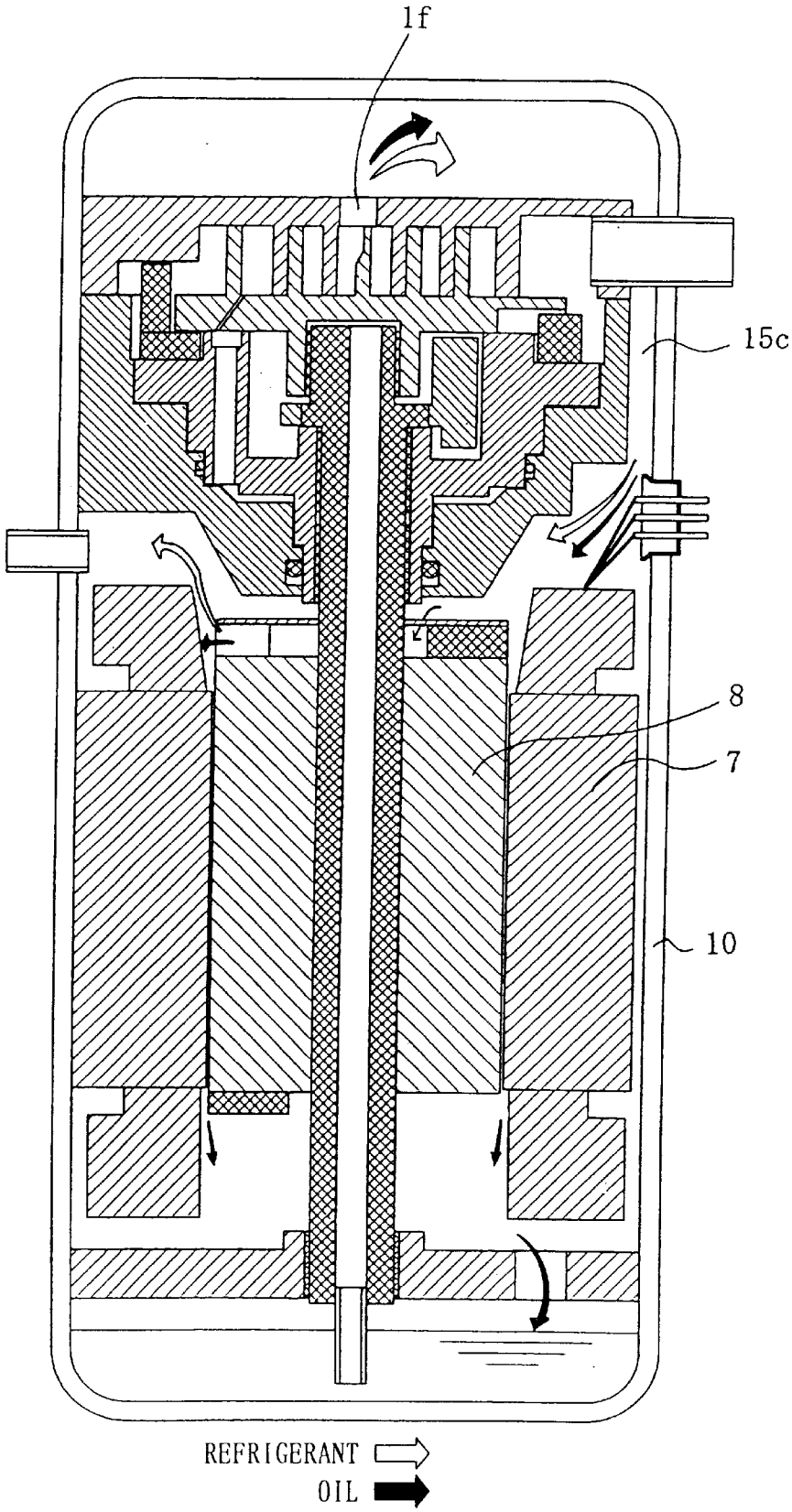
FIG. 2 shows a longitudinal sectional view of the compressor illustrating flows of refrigerant gas and refrigerating machine oil according to Embodiment 1 of the present invention.
Figure 3:
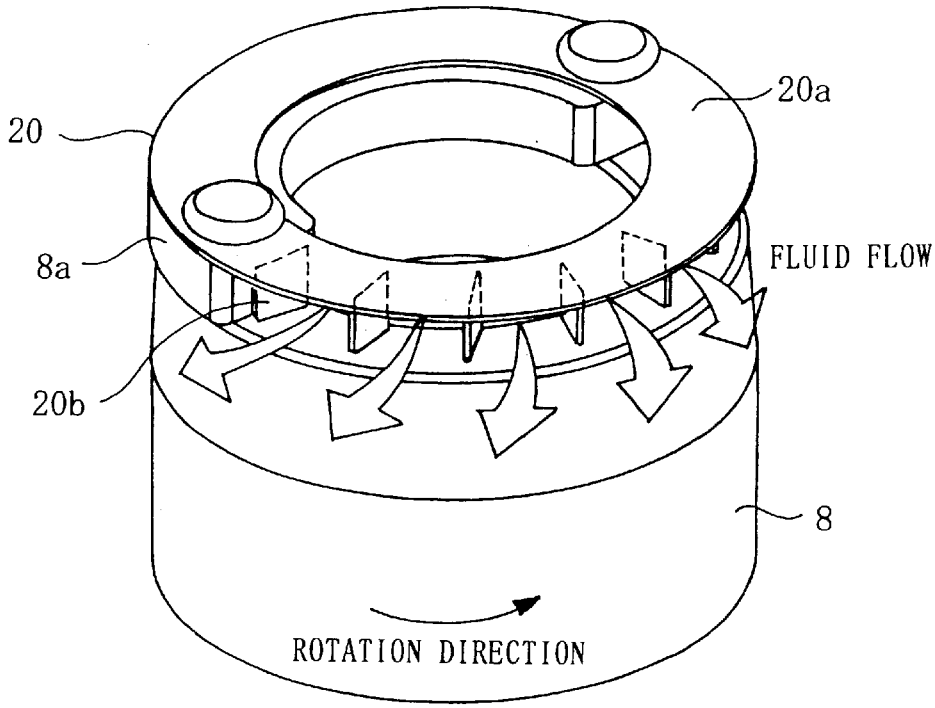
FIG. 3 is a perspective view showing principal parts of a rotor according to the present invention.

FIG. 1 shows a longitudinal sectional view of a compressor according to Embodiment 1 of the present invention. FIG. 2 shows a longitudinal sectional view of the compressor illustrating flows of refrigerant gas and refrigerating machine oil according to Embodiment 1 of the present invention. FIG. 3 is a perspective view showing principal parts of a rotor according to the present invention.

In FIG. 1, a fixed scroll 1 and a guide frame 15 are shown. The peripheral part of the fixed scroll 1 is fixed to the guide frame 15 by bolts (not shown). A spiral blade 1*b* is provided on one surface (the lower surface in FIG. 1) of a seat 1*a*, and two Oldham guide grooves 1*c* are formed in the peripheral part of the fixed scroll 1. These two Oldham guide grooves 1*c* are arranged almost in one straight line. A pair of fixed projections 9*c* of an Oldham ring 9 are engaged with the Oldham guide groove 1*c* in a reciprocally slidable manner. Furthermore, a suction tube 10*a* is pressed from the side of the fixed scroll 1 to penetrate a hermetic container 10.

A spiral blade 2*b* is provided on a seat 2*a* of an orbiting scroll 2. The form of the spiral blade 2*b* is substantially the same as the spiral blade 1*b* provided on the seat 1*a* of the fixed scroll 1. The spiral blade 1*b* and the spiral blade 2*b* geometrically form a compression chamber 1*d*. A boss part 2*f* being a hollow cylinder is provided at the central part of the surface of the seat 2*a* opposite to the surface where the spiral blade 2*b* exists. The boss part 2*f* is rotatably engaged with an orbiting shaft part 4*b* provided at the upper end of a main shaft 4. A thrust surface 2*d* is formed on the surface of the seat 2*a* opposite to the surface where the spiral blade 2*b* exists. The thrust surface 2*d* is slidably in contact with a thrust bearing 3*a* of a compliant frame 3. Moreover, a pair of Oldham guide grooves 2*e* is formed in one straight line in the peripheral part of the orbiting scroll seat 2*a*. Each of the two Oldham guide grooves 2*e* has a phase difference of about 90 degrees with respect to each of the Oldham guide grooves 1*c* of the fixed scroll 1. A pair of fixed projections 9*a* of the Oldham ring 9 are engaged with the Oldham guide groove 2*e* in a reciprocally slidable manner. An extraction hole 2*j* penetrating the compression chamber 1*d* and the thrust surface 2*d* is formed on the seat 2*a*, and refrigerant gas just being compressed is extracted from the extraction hole 2*j* and led to the thrust surface 2*d*.

The compliant frame 3 is supported in the radial direction at an upper surface 3*d* and a lower surface 3*e* provided on the external circumferential part of the compliant frame 3, by an upper surface 15*a* and a lower surface 15*b* provided on the internal circumferential part of the guide frame 15. A main bearing 3*c* and a sub-main bearing 3*h* at the center of the compliant frame 3 support the main shaft 4 rotated by a stator 7, in the radial direction. A connection passages 3*s* penetrating along the axial direction from the inside of the thrust bearing 3*a* is also provided. A thrust bearing side opening 2*k* is provided facing an orbiting scroll extraction hole 2*j*. The compression mechanism part is composed of the fixed scroll 1, the orbiting scroll 2, the compliant frame 3 and the guide frame 15, and the electric motor part is composed of the stator 7 and a rotor 8.

An external circumferential surface 15*g* of the guide frame 15 is adhered to the hermetic container 10 by means of shrinkage fitting or welding, and a passage 15*c* is formed at the outer peripheral part of the guide frame 15 by a notch or a concave part as a passage of the refrigerant. High-pressure refrigerant gas discharged from the discharge port 1*f* of the fixed scroll 1 into a discharge space 100 in the hermetic container 10 is led to a discharge tube 10*b* which is open at a first space 101 between the compression mechanism part (composed of the fixed scroll 1, the orbiting scroll 2, the compliant frame 3, the guide frame 15, etc.) and the electric motor part (composed of the stator 7, the rotor 8, etc.) through the passage 15*c* provided at the outer side of the compression mechanism part. The passage 15*c* provided at the outer side of the compression mechanism part is formed at an opposite position (opposite by around 180 degrees) with respect to the discharge tube 10*b*, and leads the refrigerant gas from the discharge space 100 to the first space 101. The case that the passage 15*c* at the outer side of the compression mechanism part is formed on the guide frame 15 has been explained above. However, any passage is acceptable as long as it connects the discharge space 100 and the first space 101, and it can be provided on any part composing the compression mechanism part.

On the internal circumferential surface of the guide frame 15, the upper surface 15*a* contacting the upper surface 3*d* of the compliant frame 3, the lower surface 15*b* contacting the lower surface 3*e* of the compliant frame 3, and two sealing grooves for containing sealing materials are provided. A sealing material 16*a* and a sealing material 16*b* are contained in the two sealing grooves. A frame space 15*f* formed by the internal circumferential surface of the guide frame 15 and the external circumferential surface of the compliant frame 3, which is sealed up by using the two sealing materials connects only with the connection passage 3*s* of the compliant frame 3, and encloses the refrigerant gas which is being compressed supplied from the extraction hole 2*j* of the orbiting scroll.

The orbiting shaft 4*b* at the upper end of the main shaft 4 is rotatably engaged with an orbiting bearing 2*c* of the orbiting scroll 2, and a main shaft balancer 4*e* is provided below the orbiting shaft 4*b* by shrinkage fitting. Furthermore, a main shaft part 4*c* which contacts, in a rotatable state, the main bearing 3*c* and the sub-main bearing 3*h* of the compliant frame 3 is provided below the main shaft balancer 4*e*. Below the main shaft 4, a sub-shaft part 4*d* which is rotatably engaged with a sub-bearing 6*a* of a sub-frame 6 is formed. The rotor 8 is provided by shrinkage fitting between the sub-shaft part 4*d* and the main shaft part 4*c*. A first balancer 8*a* is fixed to the upper end surface of the rotor 8 and a second balancer 8*b* is fixed to the lower end surface of the rotor 8. Static balance and dynamic balance are retained by the three balancers: the first balancer 8*a*, the second balancer 8*b*, and the main shaft balancer 4*e*. An oil pipe 4*f* pressed in the lower end of the main shaft 4 sucks up refrigerating machine oil 10*e* collected in an oil reservoir 10*g* at the bottom of the hermetic container 10.

A glass terminals 10*f* is installed at the side of the hermetic container 10, and a lead wire from the stator 7 is connected to the glass terminal 10*f*. The scroll compressor of the present embodiment mentioned above is a high-pressure shell type scroll compressor where the compression mechanism part is provided at the upper part of the scroll compressor, the electric motor part is provided at the lower part of the scroll compressor, the main shaft 4 which drives the compression mechanism part is contained in the hermetic container 10, and it is compressed discharge gas atmosphere inside the hermetic container 10.

According to the present embodiment of the invention, the first balancer 8*a* is provided at the semicircle part of the upper end of the rotor 8, facing the first space, for dissolving unbalance, and a fan 20 is also provided at another semicircle part of the upper end of the rotor 8, facing the first space, opposite to the semicircle where the first balancer 8*a* exists. The fan 20 sucks from the internal circumferential side and discharges to the external circumferential side. The fan 20 is composed of a plurality of blades 20*b* formed on the same place as the first balancer 8*a*, and a seat 20*a* formed above the blades 20*b* and the first balancer 8*a* and is as large as the rotor 8.

As shown in FIG. 3, the seat 20*a* is a disk which has a penetration hole in the central part made by means of a sheet metal or a blanking steel. Therefore, a space 20*c* is formed between the seat 20*a* and the main shaft 4 in the state of the main shaft 4 being adhered to the rotor 8. In this state, the fan 20 having blades 20*b* provided on the upper part of the rotor 8 performs a synchronous rotation with the main shaft 4 to which the rotor 8 is adhered by shrinkage fitting or pressing. Since the blades 20*b* is shaped to make the flow of fluid go in the outer and radial direction, a negative pressure is generated in the upper part of the rotor 8 by the rotation of the fan 20. Then, a flow is generated which sucks refrigerant gas containing refrigerating machine oil from the space 20*c* between the seat 20*a* and the main shaft 4.

Now, the basic operation of the scroll compressor according to the present invention will be explained. Sucked low-pressure refrigerant is led from the suction tube 10*a* into the compression chamber 1*d* formed by the spiral blades of the fixed scroll 1 and the orbiting scroll 2. The orbiting scroll 2 driven by the stator 7 decreases the capacity of the compression chamber 1*d* by an eccentric revolution movement. The sucked refrigerant becomes high pressure by this compression process, and is discharged into the discharge space 100 of the hermetic container 10 from the discharge port 1*f* of the fixed scroll 1.

In the above-mentioned compression process, refrigerant gas of intermediate pressure which is just being compressed is led to the frame space 15*f* from the extraction hole 2*j* of the orbiting scroll 2 through the connection passage 3*s* of the compliant frame 3, and maintains the intermediate pressure atmosphere of the frame space 15*f*. The discharged gas which has become high pressure fills the inside of the hermetic container 10 with high-pressure atmosphere and is emitted out of the compressor from the discharge tube 10*b*. Namely, the compressor is composed to be a high-pressure shell type compressor where it is high-pressure atmosphere inside the hermetic container 10.

The refrigerating machine oil 10*e* collected in the oil reservoir 10*g* at the bottom of the hermetic container 10 is led by a difference of pressure to an orbiting bearing part 2*g* through a hollow space 4*g* penetrating, along the axial direction, the main shaft 4. A space 2*h* (boss part space) surrounded by the orbiting scroll 2 and the compliant frame 3 is filled with the refrigerating machine oil 10*e* which has become intermediate pressure by a throttle action of the orbiting bearing part 2*g*. Then, the refrigerating machine oil 10*e* which has become intermediate pressure is led to a low-pressure space via a pressure adjustment valve (not shown) connecting the space 2*h* and the low-pressure atmosphere space, and sucked into the compression chamber 1*d* with the low-pressure refrigerant gas. By dint of the compression process, the refrigerating machine oil 10*e* is discharged from the discharge port 1*f* to the discharge space 100 in the hermetic container 10 with high-pressure refrigerant gas, led to the first space through the passage 15*c*, such as a notch and a concave part, provided at the outer side of the compression mechanism part, and is discharged outside of the hermetic container 10 from the discharge tube 10*b* which is opening at the first space.

A thrust gas force indicating the force of the fixed scroll 1 and the orbiting scroll 2 trying to come apart each other in the axial direction is generated by the compression action. Another force of the compliant frame 3 and the orbiting scroll 2 trying to come apart each other is generated by the intermediate pressure of the boss part space 2*h*. The total of the above forces acts on the compliant frame 3 as a downward force in the figure.

Further, a force of the frame space 15*f*, which has become intermediate pressure atmosphere by leading the refrigerant gas just being compressed, trying to make the compliant frame 3 come apart from the guide frame 15 is generated. A difference of pressure acts on an exposed part in the high pressure atmosphere at the bottom. The total of these forces acts on the compliant frame 3 as an upward force. At the time of a regular operation, it is set that the upward force exceeds the downward force. Therefore, the compliant frame 3 goes up by being guided by the upper and the lower surfaces 3*d* and 3*e*. The orbiting scroll 2 also goes up because it slidably contacts the compliant frame 3. Then, the spiral blade 2*b* of the orbiting scroll 2 contacts the fixed scroll 1 and makes it move.

As the thrust gas force mentioned above becomes large at the time of an operation starting and liquid compressing, the orbiting scroll 2 strongly makes the compliant frame 3 go downward through the thrust bearing 3*a*. Then, a comparatively big space is generated at the top and the bottom of the spiral blade of the orbiting scroll 2 and the fixed scroll 1. Therefore, it is possible to perform a so-called pressure relief, which indicates it is possible to avoid an unusual pressure rise in the compression chamber.

A part or all of the overturning moment generated in the orbiting scroll 2 is transmitted to the compliant frame 3 through the thrust bearing 3*a*. However, a resultant of a bearing load received from the main bearing 3*c* and its reaction force, meaning a couple of forces generated by resultant of reaction forces received from the upper and the lower surfaces 3*d* and 3*e* of the compliant frame 3 contacting the guide frame 15, negates the overturning moment. Accordingly, high operation stability at the time of a regular operation, and high relief operation stability can be secured.

Since the blade 20*b* provided at the end of the rotor 8, facing the first space 101, is shaped to make the flow of fluid go in the outer and radial direction, a negative pressure is generated at the upper part (the first space 101) of the rotor 8, by the rotation of the fan 20 accompanied by the rotation of the main shaft 4. Then, a flow sucking the refrigerant gas and the refrigerating machine oil from the space 20*c* between the seat 20*a* and the main shaft 4 is also generated. Further, a flow of sucking mixed gas of the refrigerant gas and the refrigerating machine oil from the internal circumference side of the rotor 8 and discharging it to the external circumferential side is generated.

Therefore, the mixed gas of the refrigerant gas and the refrigerating machine oil flows from the center of the upper part (the first space 101) of the rotor 8 to the external circumferential side, and collides with a first coil end of the stator 7, facing the first space 101. Then, the refrigerating machine oil is separated from the refrigerant gas and made to go back to the oil reservoir 10*g* through the air gap etc.

According to the compressor of Embodiment 1 of the present invention constituted as stated above, since the separation efficiency of the refrigerant gas and the refrigerating machine oil is improved, the pressure loss and the heat-conducting performance aggravation in the unit decrease, which enhances the efficiency of the unit. Furthermore, the reliability of the compressor can be enhanced because seizure of the bearing of the compressor caused by oil lack seldom occurs.

Since the blade 20*b* is provided on the semicircle side opposite to the first balancer 8*a* so that it can be equal to or shorter than the height of the first balancer 8*a*, the blade 20*b* never becomes higher (larger) than the first balancer 8*a*. Therefore, it becomes possible to make the space for installing the fan 20 small and to miniaturize the compressor consequently.

However, in the case of the blade 20*b* being provided only on the semicircle side counter to the first balancer 8*a*, when air volume is lacking and the oil separation effect is not enough, it is also acceptable to provide the blades 20*b* all over the circumference at the upper part of first balancer 8*a* though the fan 20 becomes higher than first balancer 8*a*.

Moreover, although the blade 20*b* is provided below the seat 20*a* according to the present Embodiment, it is also acceptable to provide the blade 20*b* above the seat 20*a* or both below and above the seat 20*a*. If the seat 20*a* of the fan 20 is fixed to the rotor 8 by the caulker with the first balancer 8*a* as shown in FIG. 3, a special structure for fixing the fan 20 to the rotor 8 is not needed. Therefore, it is possible to reduce the cost of the compressor manufacturing and to further miniaturize the compressor.

Figure 4:
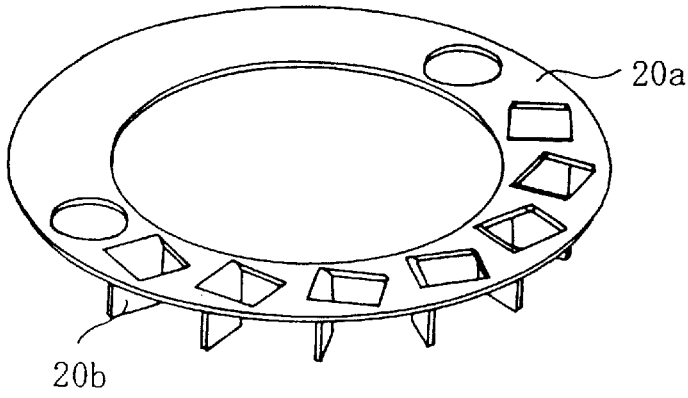
FIG. 4 illustrates the structure of a fan according to the Embodiment 1 of the present invention.

It is also acceptable to mold the blade 20*b* of the fan 20 as one part of the seat 20*a* and to cut out and bend up the shape of the blade 20*b* by a sheet metal processing etc. as shown in FIG. 4. FIG. 4 illustrates the structure of the fan according to the Embodiment 1 of the present invention. Thus, according to the structure of FIG. 4, it is possible to manufacture the fan 20 at low cost, and the cost of the compressor manufacture can be reduced. Moreover, the assembly of the fan 20 becomes easy. The same effect can be acquired if the blade 20*b* is molded as one part of the end ring of the rotor 8 by a casting processing etc.

As mentioned above, the following are provided in the compressor according to the present embodiment: the compression mechanism part contained in the hermetic container 10, compressing the refrigerant sucked from the outside of the hermetic container 10, and discharging the compressed refrigerant to the discharge space 100 in the hermetic container 10, the electric motor part contained in the hermetic container 10, arranged in the first space 101 in the hermetic container 10, which is opposite to the discharge space 100 along the axial direction with respect to the compression mechanism part, composed of the stator 7 and the rotor 8, and driving the compression mechanism part through the main shaft 4, the passage 15*c* provided at the outer side of the compression mechanism part, connecting the discharge space 100 and the first space 101 for the purpose of leading the refrigerant discharged into the discharge space 100 to the first space 101 through the discharge tube 10*b*, and the fan 20 provided at the end of the rotor 8, facing the first space 101. Since the refrigerant discharged in hermetic container 10 is led to the first space 101 to be discharged out of the hermetic container 10 from the discharge tube 10*b* after being separated from the oil by the fan 20, separation of the refrigerant gas and the refrigerating machine oil can be performed by the fan 20. Therefore, the separation efficiency of the refrigerating machine oil is improved, and bearing seizure of the compressor caused by oil lack seldom occurs, which makes the reliability of the compressor increased. In addition, the pressure loss and the heat-conducting performance aggravation in the unit decrease, which enhances the efficiency of the unit.

Moreover, since the fan 20 is fixed with the first balancer 8*a* provided at the end of the rotor 8, facing the first space 101, by the caulker, it is possible to reduce the cost of the compressor manufacture and to further miniaturize the compressor. Since the blade 20*b* of the fan 20 is molded as one part of the seat 20*a* by a sheet metal processing etc., it is possible to manufacture the fan 20 at low cost. Accordingly, the cost of the compressor manufacture can be reduced. Moreover, the assembly of the fan 20 becomes easy.

The height of the fan 20, meaning the length from the bottom to the top of the fan, is almost the same as the height of the first balancer, meaning the length from the bottom to the top of the first balancer. Namely, the location of the upper surface of the fan 20 and the location of the upper surface of the first balancer are almost on one plane. The upper surface (top) of the fan 20 and the upper surface (top) of the first balancer face the first space, and the lower surface (bottom) of the fan 20 and the lower surface (bottom) of the first balancer are fixed to the rotor 8. Therefore, the fan 20 never projects along the axial direction from the first balancer, which makes the compressor miniaturized. Since the passage 15*c*, provided at the outer side of the compression mechanism part, is located at a position away from the discharge tube 10*b* by about 90 degrees or greater than 90 degrees of the phase angle along the direction of the circumference (the opposite side by 180 degrees preferable), the distance up to the discharge tube 10*b* in the first space 101 can be made long. Then, as the refrigerant gas is separated from the refrigerating machine oil in the long distance, the compressor of high reliability where outflow of oil is small can be obtained.

The high-pressure shell type scroll compressor has been explained above. However, the compressor is not restricted to the scroll compressor. The same effect can also be acquired in a rotary compressor, a reciprocating compressor, and other compressors.

Embodiment 2

Figure 5:
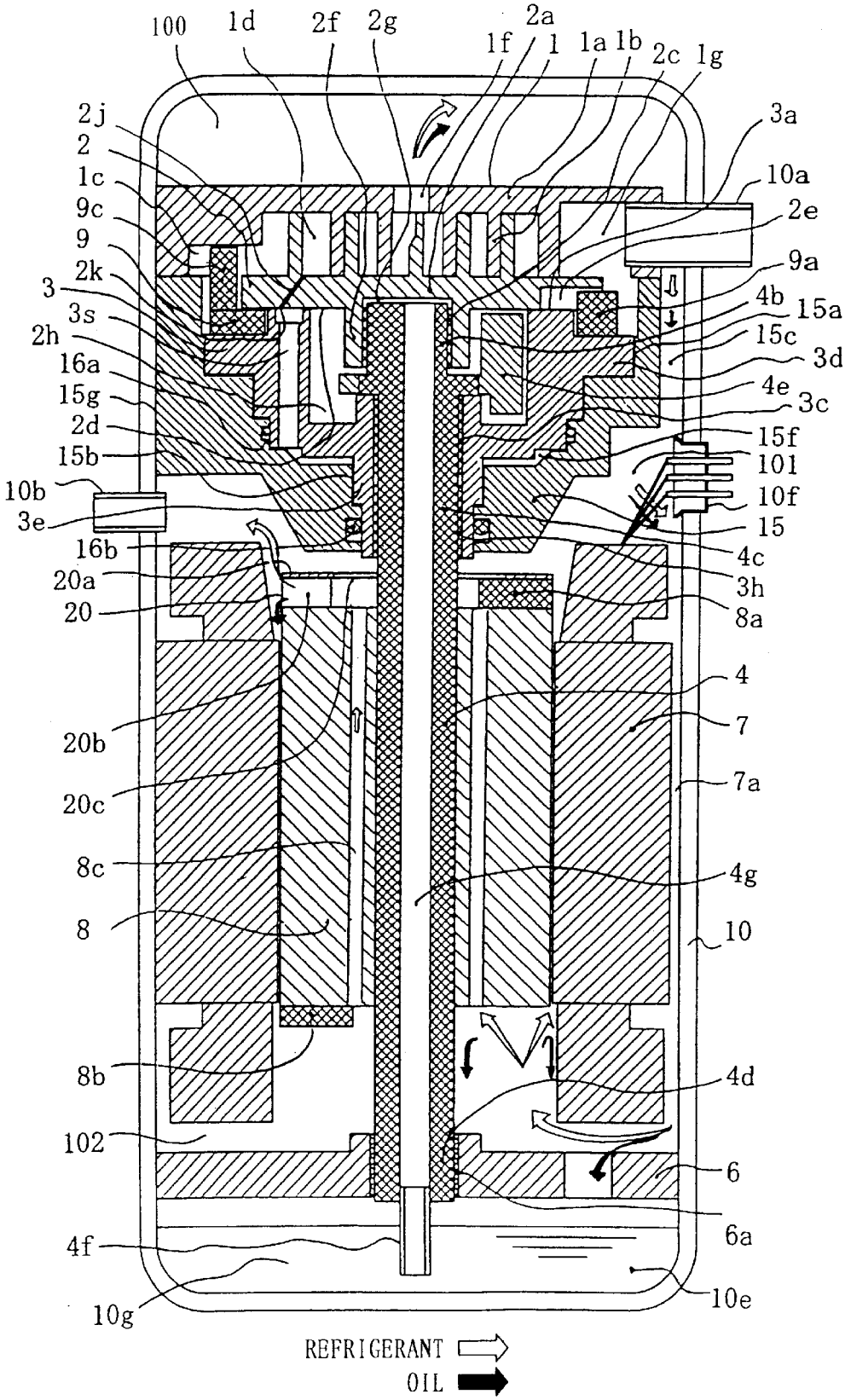
FIG. 5 shows a longitudinal sectional view of a compressor according to Embodiment 2 of the present invention.

Embodiment 2 according to the present invention will now be explained. As shown in FIG. 5, the compressor of this embodiment is the one in which a passage 8*c* penetrating, along the axial direction, the rotor 8 is provided at the compressor of the Embodiment 1. FIG. 5 is a longitudinal section of the compressor of Embodiment 2 of the present invention. In FIG. 5, the same elements as those in FIG. 1 or FIG. 4 have the same references, and explanation for them is omitted. In FIG. 5, the passage 8*c* penetrating along the axial direction is provided at the rotor 8. The air gap provided at this passage 8*c* or provided between the stator 7 and the rotor 8 constitutes an internal circumferential side passage in the electric motor. As constituted as the above, the refrigerant gas containing refrigerating machine oil led between the guide frame 15 and the electric motor element (the stator 7, rotor 8) descends through a passage 7*a* at the external circumferential side of the electric motor. This passage 7*a* at the external circumferential side of the electric motor is formed by a notch or a concave part. Then, after the refrigerant gas reached the second space 102 (lower space of the electric motor) in the hermetic container, a flow which goes up through the internal circumferential side passage in the electric motor (the passage 8*c* of the rotor 8 or the air gap) is generated.

The passage 7*a* at the external circumferential side of the electric motor provided in the peripheral part of the stator 7 is used as a downward passage of the refrigerant, and the passage at the internal circumferential side of the electric motor (the passage 8*c* being a penetrating hole provided at the rotor 8 or the air gap) is used as an upward passage of the refrigerant. When the refrigerant descends through the passage 7*a* at the external circumferential side of the electric motor (notch, concave part etc.) and when the refrigerant ascends through the passage at the internal circumferential side of the electric motor (the passage 8*c* of the rotor 8 or the air gap), the refrigerating machine oil is separated.

Moreover, the refrigerating machine oil is also separated when the direction of the flow changes from the downward flow to the upward flow. Furthermore, the refrigerant gas having ascended through the passage 8*c* is sucked from internal circumferential side of the fan 20, is blown away in the direction of the external circumferential side by the blade 20*b*, and collides against the first coil end of the stator 7, facing the first space 101, and consequently the refrigerating machine oil is separated. Then, the refrigerating machine oil separated from the refrigerant gas trickles down the inner wall of the hermetic container 10, the passage 8*c* of the rotor 8, and the air gap between the stator 7 and the rotor 8, to return to the oil reservoir 10*g*.

According to the compressor constituted as stated above, since the separation efficiency of the refrigerant gas and the refrigerating machine oil is improved, the pressure loss and the aggravation of heat-conducting performance in the unit decrease, which enhances the efficiency of the unit. Furthermore, the reliability of the compressor can be enhanced because seizure of the bearing of the compressor caused by oil lack seldom occurs.

Moreover, after the refrigerant gas containing refrigerating machine oil descends through the passage 7*a* at the external circumferential side of the electric motor provided at the stator 7 and reaches the second space 102, the refrigerant gas containing refrigerating machine oil ascends through the passage at the internal circumferential side of the electric motor, that is both the opening (air gap) between the stator 7 and the rotor 8 and the passage 8*c* provided at the rotor 8. Thereby, the flow area of the refrigerant gas including refrigerating machine oil can be increased and the flow velocity of the refrigerant passing through the passage at the internal circumferential side in the electric motor can be decreased. Accordingly, the separation efficiency of the refrigerant gas and the refrigerating machine oil can be improved.

According to the compressor of Embodiment 2 of the present invention, since the separation efficiency of the refrigerant gas and the refrigerating machine oil is improved, the pressure loss and the aggravation of heat-conducting performance in the unit decrease, which enhances the efficiency of the unit. Furthermore, the reliability of the compressor can be enhanced because seizure of the bearing of the compressor caused by oil lack seldom occurs.

As mentioned above, the following are provided in the compressor according to the present Embodiment: the passage 7*a* at the external circumferential side of the electric motor which is provided in the peripheral side of the stator 7 and which connects the first space 101 and the second space 102 being provided at the opposite side in the axial direction of the first space 101 with respect to the electric motor part, the passage at the internal circumferential side of the electric motor (the passage 8*c* provided at the rotor 8 or the air gap) which is provided between the stator 7 and the rotor 8 or provided at the rotor 8 and which connects the second space 102 and first space 101, and the fan 20 for oil separation provided at the end of the rotor 8, facing the first space 101, which sucks from the internal circumferential side and discharges to the external circumferential side. The refrigerant in the hermetic container 10 is passed through in order of the passage 7*a* at the external circumferential side of the electric motor, the passage at the internal circumferential side of the electric motor (passage 8*c* or the air gap) and the fan 20, and finally discharged from outside of the hermetic container 10.

Therefore, the flow area of the refrigerant gas containing refrigerating machine oil can be increased and the flow velocity of the refrigerant which passes through the passage at the internal circumferential side in the electric motor is decreased. Accordingly, the separation efficiency of the refrigerant gas and the refrigerating machine oil improves, and the reliability of the compressor can be enhanced because seizure of the bearing of the compressor caused by oil lack seldom occurs. Moreover, since the passage 7*a* at the external circumferential side of the electric motor and the passage at the internal circumferential side of the electric motor are provided in the electric motor, the electric motor can be efficiently cooled, and the performance can be enhanced. Furthermore, burning loss and over-current of the electric motor caused by overheating can be controlled, and the compressor of high reliability can be obtained.

In addition, since the passage 8*c* at the internal circumferential side of the electric motor can be formed as at least one or greater than one penetration hole penetrating along the axial direction with respect to the rotor 8, it is possible to provide the refrigerant passage in the rotor by the easy composition of just piercing a steel plate. Since the passage 7*a* at the external circumferential side of the electric motor can be formed as a notch, a concave part or a penetration hole provided at the external circumferential side of the stator, it is possible to provide the refrigerant passage in the stator by the easy composition of just piercing a steel plate.

Embodiment 3

Figure 6:
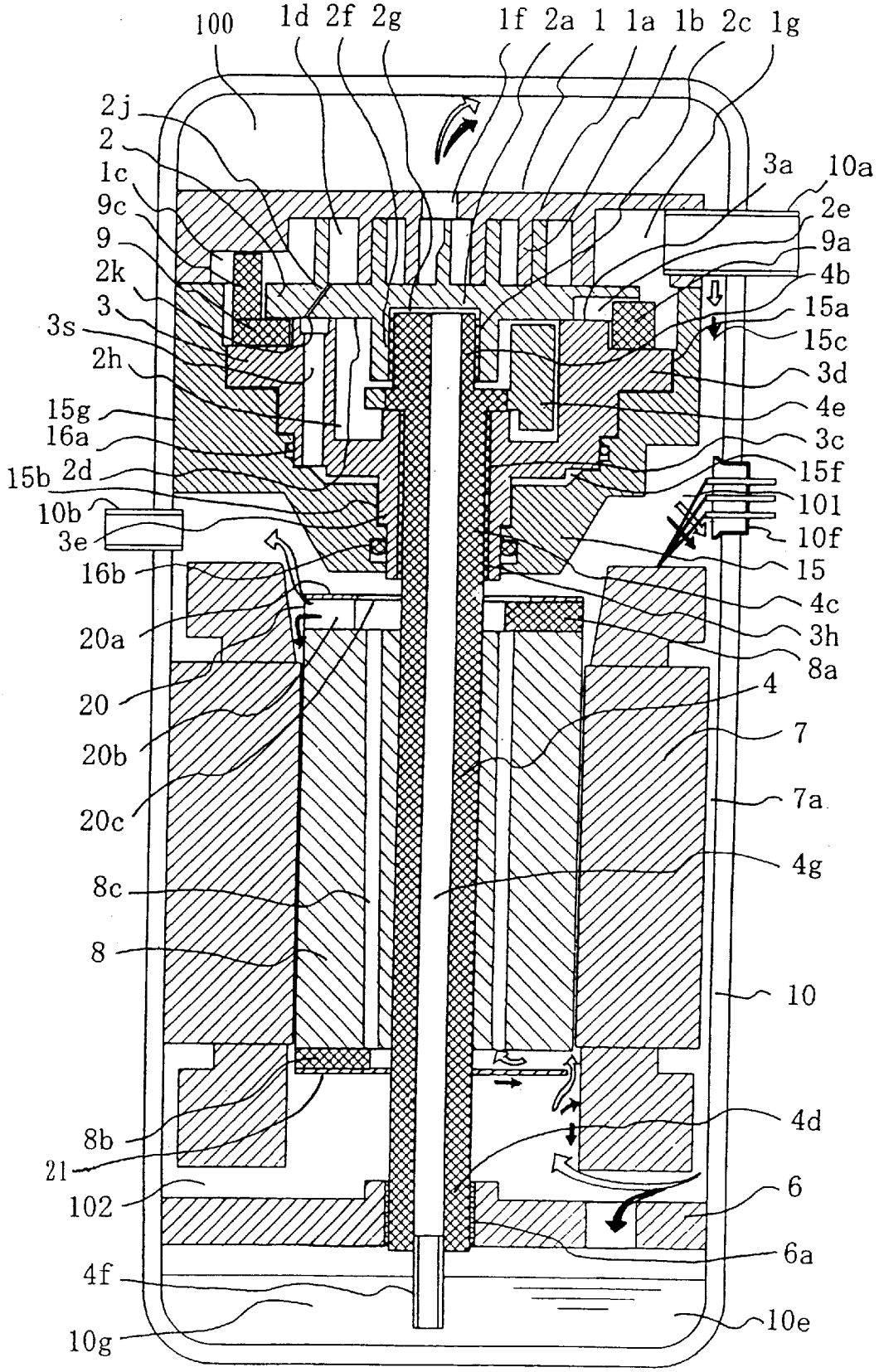
FIG. 6 shows a longitudinal sectional view of the compressor according to Embodiment 2 of the present invention.

Embodiment 3 according to the present invention will now be explained. As shown in FIG. 6, the compressor of this embodiment is the one in which a plate 21 that synchronously rotates with the main shaft driving the compression mechanism part is provided at the lower part of the rotor 8 of the compressor of Embodiment 1 or Embodiment 2.

FIG. 6 is a longitudinal section of the compressor of Embodiment 3 of the present invention. In FIG. 6, the same elements as those in FIG. 1 or FIG. 5 have the same references, and explanation for them is omitted. In FIG. 6, the plate 21 is provided below the second balancer 8*b* at the lower end of the rotor 8 (facing the second space 102). As the external diameter of the plate 21 is shorter than the internal diameter of the second coil end 7*b* of the stator 7, there is a space between the external diameter of the plate 21 and the internal diameter of the second coil end 7*b* of the stator 7. The refrigerant gas can pass through this space.

Therefore, when the compressor constituted as mentioned above is operated, after the refrigerant gas sucked from the suction tube 10*a* is compressed in the compression mechanism part, the refrigerant gas is discharged into the hermetic container 10 from the discharge port 1*f*. Then, after the refrigerant gas descends the passage 7*a* at the external circumferential side of the electric motor (a notch, a concave part, etc.) provided at the stator 7 and reached the second space 102 in the hermetic container 10, the refrigerant gas ascends the passage at the internal circumferential side in the electric motor (the passage 8*c* of the rotor 8 or the air gap). At this time, since the refrigerant gas including the refrigerating machine oil collides with the plate 21 provided at the rotor 8 facing the second space 102, a centrifugal force is given to the refrigerant gas. The refrigerating machine oil whose specific gravity is heavier than that of the refrigerant gas collides with the second coil end 7*b* of the stator 7 to be given a centrifugal separation. The separated refrigerating machine oil trickles through the second coil end 7*b*, and an oil return hole 6*b* of the sub frame 6 to drop toward the oil reservoir 10*g*.

The refrigerant gas having ascended the passage 8*c* is blown away from the internal circumferential side of the fan 20 in the direction of the external circumferential side by the blade 20*b*, and collides against the first coil end of the stator 7, facing the first space 101, and consequently the refrigerating machine oil is separated. Then, the refrigerating machine oil separated from the refrigerant gas trickles down the inner wall of the hermetic container 10, the passage 8*c* of the rotor 8, and the air gap between the stator 7 and the rotor 8, to return to the oil reservoir 10*g*.

According to the compressor constituted as stated above, since the separation efficiency of the refrigerant gas and the refrigerating machine oil is improved, the pressure loss and the aggravation of heat-conducting performance in the unit decrease, which enhances the efficiency of the unit. Furthermore, the reliability of the compressor can be enhanced because seizure of the bearing of the compressor caused by oil lack seldom occurs.

The case where the fan 20 is provided at the upper part of the rotor 8 has been explained in the present Embodiment. However, by means of providing only the plate 21, the oil separation effect can also be obtained even if the fan 20 is not provided at the upper part of the rotor 8. The cost reduction can be executed because the fan 20 is not provided.

Figure 7:
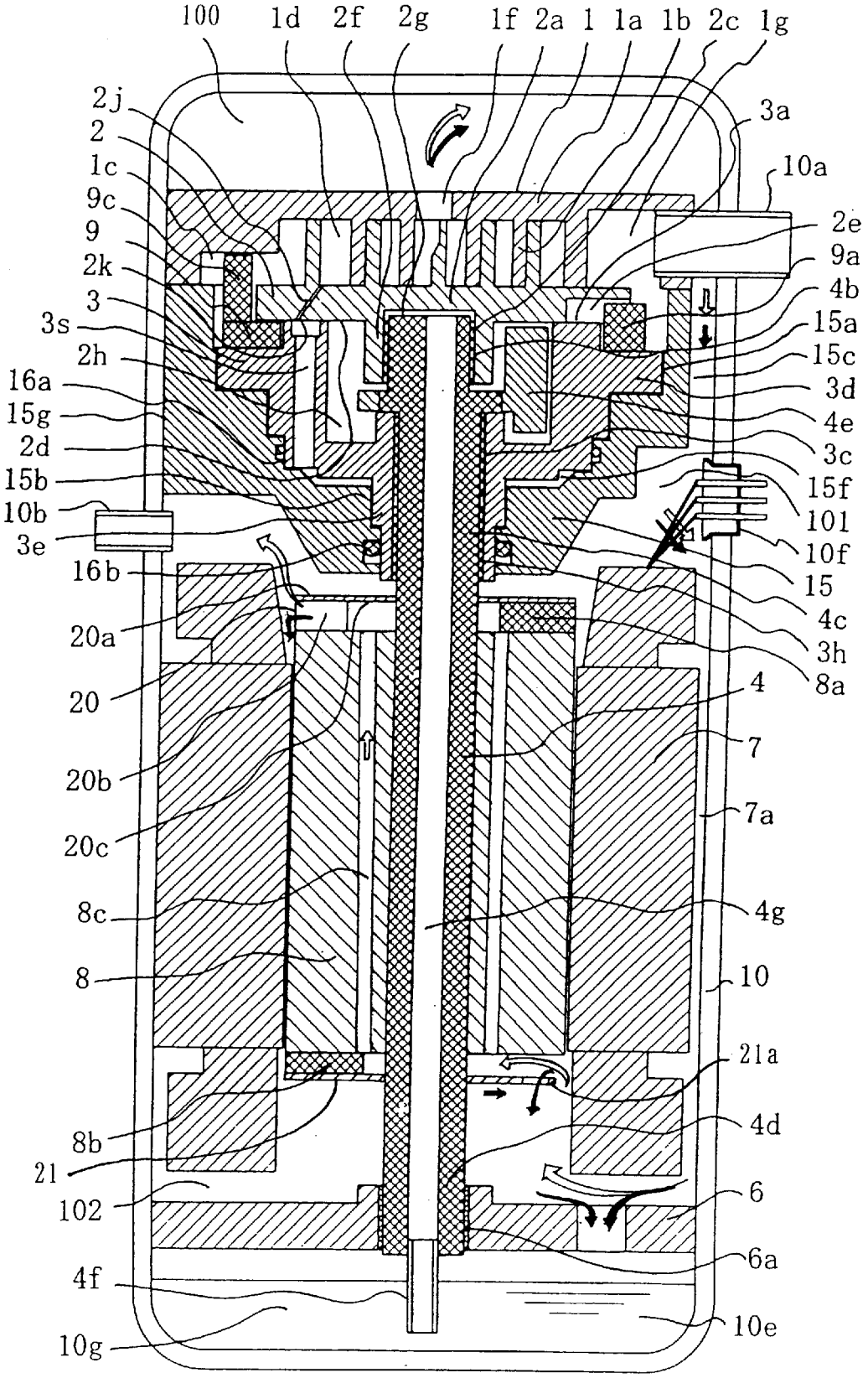
FIG. 7 shows a longitudinal sectional view of the compressor according to Embodiment 3 of the present invention.
Figure 8:
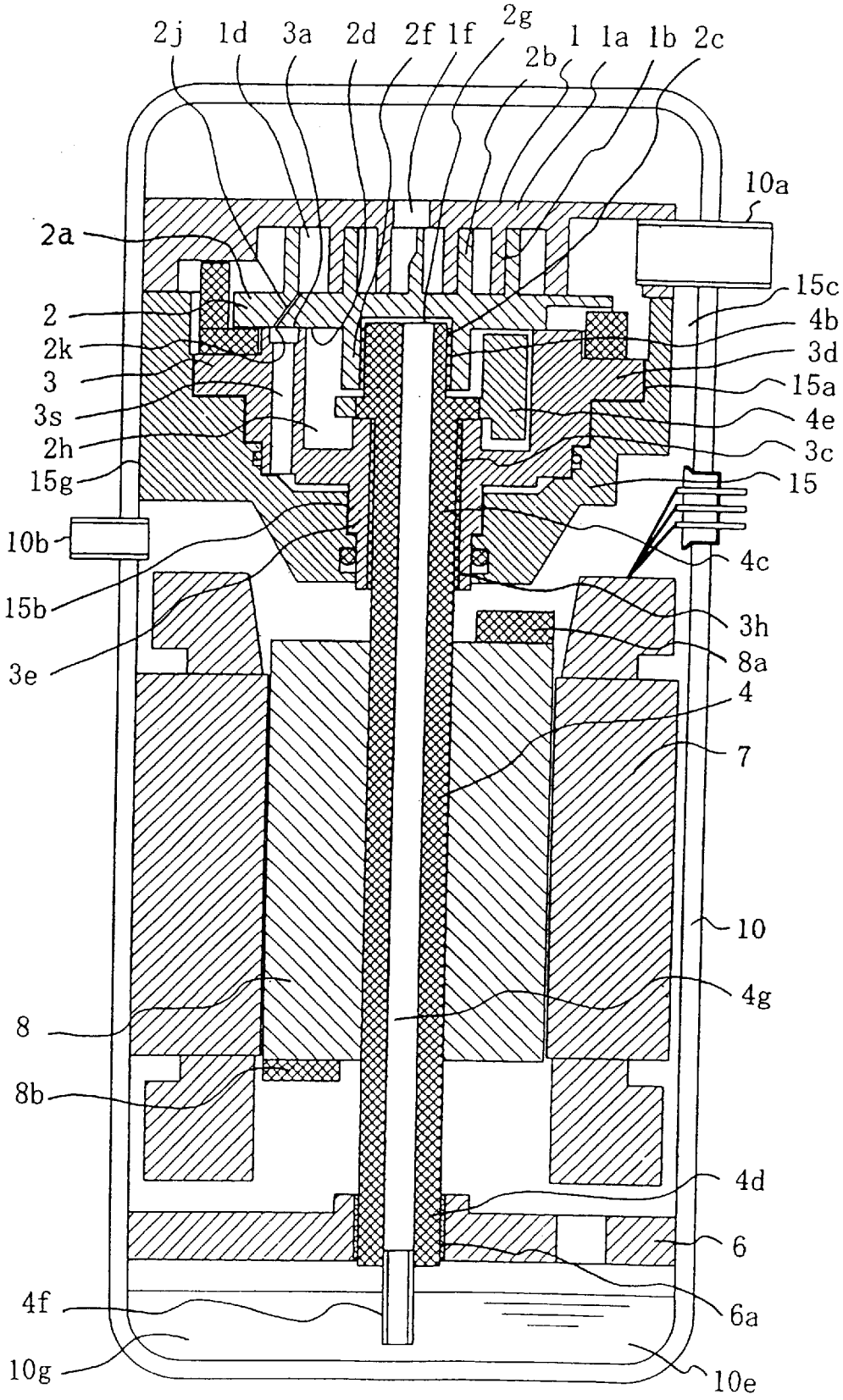
Fig. 8 RELATED ART
FIG. 8 shows a longitudinal sectional view of a conventional compressor.
Figure 9:
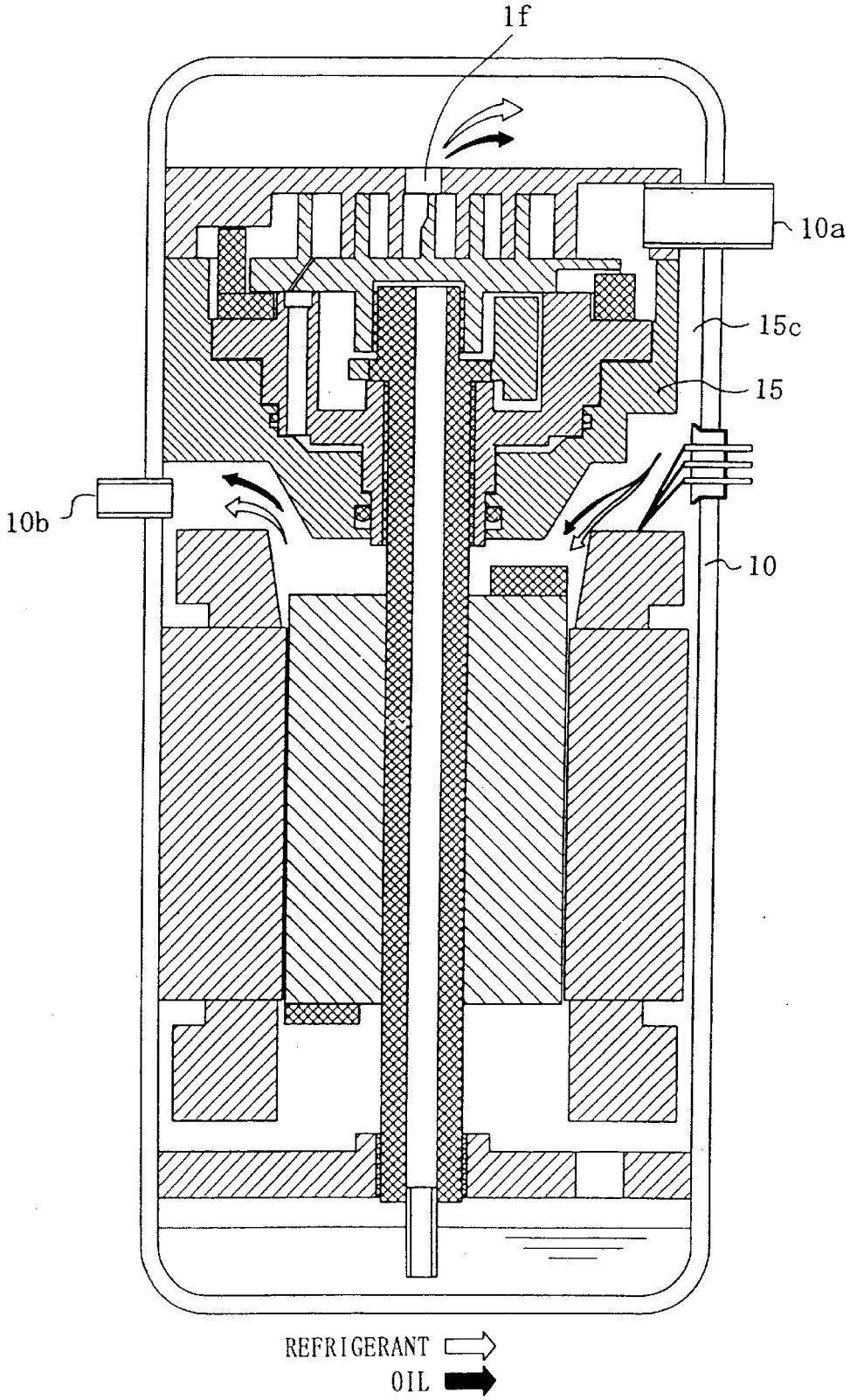
Fig. 9 RELATED ART
FIG. 9 shows a longitudinal sectional view of the conventional compressor illustrating flows of refrigerant gas and refrigerating machine oil according to Embodiment 1 of the present invention.

Moreover, it is also acceptable to form one or greater than one hole 21*a* in the plate 21 provided below the rotor 8 as shown in FIG. 7. FIG. 7 is a longitudinal sectional view of another compressor according to Embodiment 3 of the present invention. In the figure, one or greater than one penetration hole 21*a* for oil return is provided in the plate 21.

By dint of this configuration, the refrigerating machine oil which was separated from the refrigerant gas at the place (the passage 8*c*, the fan 20, etc.) upper than the plate 21 has descended and passes through the hole 21*a* in the plate 21 to be discharged from the lower part of the plate 21 toward the oil reservoir 10*g*. Thus, the oil return improves and it is possible to suppress the separated refrigerating machine oil being mixed again with the refrigerant gas.

According to the compressor of Embodiment 3 of the present invention, since the separation efficiency of the refrigerant gas and the refrigerating machine oil is improved, the pressure loss and the aggravation of heat-conducting performance in the unit decrease, which enhances the efficiency of the unit. Furthermore, the reliability of the compressor can be enhanced because seizure of the bearing of the compressor caused by oil lack seldom occurs.

Moreover, it is also acceptable to fix the plate 21 by the caulker with the second balancer 8*b* of the rotor 8. By dint of this configuration, since a special structure for fixing the plate 21 to the rotor 8 is not needed, it becomes possible to reduce the cost and to further miniaturize the compressor.

Constituted as have mentioned above, since the plate 21 for oil separation is provided at the end of the rotor 8, facing the second space 102, the refrigerant gas containing refrigerating machine oil collides with the plate 21 and a centrifugal force is given by the plate 21. A centrifugal separation is given to the refrigerating machine oil whose specific gravity is heavier than that of the refrigerant gas, and the refrigerating machine oil is blown away in the direction to be collided with the second coil end 7*b* of the stator 7. Then, no refrigerating machine oil is discharged out of the compressor. Therefore, the reliability of the compressor can be enhanced because seizure of the bearing of the compressor seldom occurs.

Moreover, as one or greater than one penetration hole 21*a* is formed in the plate 21, the refrigerating machine oil which was separated from the refrigerant gas has descended and passes through the penetration hole 21*a* in the plate 21 to be discharged from the lower part of the plate 21 toward the oil reservoir 10*g*. Thus, the oil return improves and it is possible to suppress the separated refrigerating machine oil being mixed again with the refrigerant gas. As the plate 21 is fixed by the caulker with the second balancer 8*b* of the rotor 8, a special structure for fixing the plate 21 to the rotor 8 is not needed. Therefore, it becomes possible to reduce the cost and to further miniaturize the compressor.

EFFECTS OF THE INVENTION

According to the first aspect of the compressor of the present invention, the compressor includes: the compression mechanism part, included in the hermetic container, for compressing refrigerant sucked from the outside of the hermetic container and discharging compressed refrigerant to the discharge space in the hermetic container; the electric motor part composed of the stator and the rotor, facing the first space which is at the opposite side, along the axial direction, of the discharge space with respect to the compression mechanism part in the hermetic container, for driving the compression mechanism part through the main shaft; the discharge tube provided in the hermetic container, being open to the first space; the passage at the external circumferential side of the compression mechanism part, for connecting the discharge space with the first space; and the fan provided at the end of the rotor, facing the first space, wherein the refrigerant discharged into the discharge space passes through the passage at the external circumferential side of the compression mechanism part to reach the first space, and passes the fan to be discharged to the outside of the hermetic container.

Accordingly, it is possible to perform the separation of the refrigerant gas from the refrigerating machine oil, at the fan or at the passage provided at the external circumferential side of the compressor. The separation efficiency of the refrigerating machine oil is improved and the reliability of the compressor can be enhanced because seizure of the bearing of the compressor caused by oil lack seldom occurs. Besides, as the pressure loss and the aggravation of heat-conducting performance in the unit decrease, the efficiency of the unit is enhanced.

According to the second aspect of the compressor of the present invention, the compressor includes: the passage at the external circumferential side of the electric motor, provided at the external circumferential side of the stator, for connecting the first space and the second space which is at the opposite side, along the axial direction, of the first space with respect to the electric motor part; and the passage at the internal circumferential side of the electric motor, provided at between the stator and the rotor or in the rotor, for connecting the first space and the second space, wherein the fan sucks the refrigerant from the internal circumferential side of the fan and discharges the refrigerant to the external circumferential side of the fan, and wherein the refrigerant passes in order of the passage at the external circumferential side of the electric motor, the passage at the internal circumferential side of the electric motor, and the fan, and is discharged to the outside of the hermetic container.

Accordingly, the separation efficiency of the refrigerating machine oil from the refrigerant gas is improved because of the flow change from the downward flow to the upward flow and because of the upward flow in the passage at the internal circumferential side of the electric motor. The reliability of the compressor is enhanced because seizure of the bearing of the compressor caused by oil lack seldom occurs. Moreover, since the passage at the external circumferential side of the electric motor and the passage at the internal circumferential side of the electric motor are provided in the electric motor, the electric motor can be efficiently cooled, and the performance can be enhanced. Furthermore, burning loss and over-current of the electric motor caused by overheating can be controlled, and the compressor of high reliability can be obtained.

According to the third aspect of the compressor of the present invention, the passage at the internal circumferential side of the electric motor is formed as at least one penetration hole, penetrating along the axial direction, provided at the rotor. It is possible to provide the refrigerant passage in the rotor by the easy composition of just piercing a steel plate. As the flow area can be increased, the flow velocity of the refrigerant passing through the passage at the internal circumferential side in the electric motor can be decreased. Accordingly, the separation efficiency of the refrigerant gas from the refrigerating machine oil can be improved. Therefore, seizure of the bearing of the compressor caused by oil lack seldom occurs.

According to the fourth aspect of the compressor of the present invention, the passage at the external circumferential side of the electric motor is formed as a concave part provided at the external circumferential side of the stator. Thus, it is possible to provide the refrigerant passage in the stator by the easy composition of just piercing a steel plate.

According to the fifth aspect of the compressor of the present invention, the rotor includes a plate for oil separation at the end of the rotor, facing the second space. Since the refrigerant gas including the refrigerating machine oil collides with the plate, and a centrifugal force is given to the refrigerant gas. The refrigerating machine oil whose specific gravity is heavier than that of the refrigerant gas is given a centrifugal separation and flown in the direction of being collided with the second coil end of the stator 7. Then, the refrigerating machine oil is not discharged to the outside of the compressor. The reliability of the compressor is enhanced because seizure of the bearing seldom occurs.

According to the sixth aspect of the compressor of the present invention, the plate includes at least one penetration hole. Accordingly, the refrigerating machine oil which was separated from the refrigerant gas and has descended, is discharged through the penetrating hole in the plate toward the oil reservoir 10*g* from the lower part of the plate 21. Thus, the oil return improves and it is possible to suppress the separated refrigerating machine oil being mixed again with the refrigerant gas.

According to the seventh aspect of the compressor of the present invention, the plate is fixed by a caulker with the second balancer provided at the end of the rotor, facing the second space. A special structure for fixing the plate to the rotor is not needed. Therefore, it is possible to reduce the cost of the compressor manufacturing and to further miniaturize the compressor.

According to the eighth aspect of the compressor of the present invention, a surface of the fan and a surface of the first balancer which faces the first space, are located on one plane. Thus, as the fan never projects along the axial direction from the first balancer, it is possible to miniaturize the compressor.

According to the ninth aspect of the compressor of the present invention, the fan is fixed by a caulker with the first balancer provided at the end of the rotor, facing the first space. Therefore, it is possible to reduce the cost of the compressor manufacturing and to further miniaturize the compressor.

According to the tenth aspect of the compressor of the present invention, the passage at the external circumferential side of the compressor part is located at a position away from the discharge tube by degrees equal to 90 degrees or greater than 90 degrees of a phase angle along a direction of a circumference. The distance for the refrigerant gas and the refrigerating machine oil to pass up to the discharge tube in the first space can be made long. The refrigerating machine oil is separated from the refrigerant gas in the long distance. Thus, the compressor of high reliability where outflow of oil is small can be obtained.

Having thus described several particular embodiments of the invention, various alterations, modifications, and improvements will readily occur to those skilled in the art. Such alterations, modifications, and improvements are intended to be part of this disclosure, and are intended to be within the spirit and scope of the invention. Accordingly, the foregoing description is by way of example only, and not intended to be limiting. The invention is limited only as defined in the following claims and the equivalents thereto.

What is claimed is:

1. A compressor comprising:

a compression mechanism part, included in a hermetic container, for compressing refrigerant sucked from an outside of the hermetic container and discharging compressed refrigerant to a discharge space in the hermetic container;

an electric motor part composed of a stator and a rotor, facing a first space which is at an opposite side, along an axial direction, of the discharge space with respect to the compression mechanism part in the hermetic container, for driving the compression mechanism part through a main shaft;

a discharge tube provided in the hermetic container, being open to the first space;

a passage at an external circumferential side of the compression mechanism part, for connecting the discharge space with the first space; and a fan provided at an end of the rotor, facing the first space, wherein the refrigerant discharged into the discharge space passes through the passage at the external circumferential side of the compression mechanism part to reach the first space, and passes the fan to be discharged to the outside of the hermetic container.

2. The compressor of claim 1 further including:

a passage at an external circumferential side of an electric motor, provided at an external circumferential side of the stator, for connecting the first space and a second space which is at an opposite side, along the axial direction, of the first space with respect to the electric motor part; and a passage at an internal circumferential side of the electric motor, provided at one of positions of between the stator and the rotor and in the rotor, for connecting the first space and the second space, wherein the fan sucks the refrigerant from the an internal circumferential side of the fan and discharges the refrigerant to an external circumferential side of the fan, and wherein the refrigerant passes in order of the passage at the external circumferential side of the electric motor, the passage at the internal circumferential side of the electric motor, and the fan, and is discharged to the outside of the hermetic container.

3. The compressor of claim 2, wherein the passage at the internal circumferential side of the electric motor is formed as at least one penetration hole, penetrating along the axial direction, provided at the rotor.

4. The compressor of claim 3, wherein the passage at the external circumferential side of the electric motor is formed as a notch or a concave part provided at the external circumferential side of the stator.

5. The compressor of claim 3, wherein the rotor includes a plate for oil separation at an end of the rotor, facing the second space.

6. The compressor of claim 2, wherein the passage at the external circumferential side of the electric motor is formed as a notch or a concave part provided at the external circumferential side of the stator.

7. The compressor of claim 6, wherein the rotor includes a plate for oil separation at an end of the rotor, facing the second space.

8. The compressor of claim 2, wherein the rotor includes a plate for oil separation at an end of the rotor, facing the second space.

9. The compressor of claim 8, wherein the plate includes at least one penetration hole.

10. The compressor of claim 8, wherein the plate is fixed by a caulker with a second balancer provided at the end of the rotor, facing the second space.

11. The compressor of claim 2, wherein a surface of the fan and an upper surface of a first balancer provided at the end of the rotor are located on one plane.

12. The compressor of claim 2, wherein the fan is fixed by a caulker with a first balancer provided at the end of the rotor, facing the first space.

13. The compressor of claim 2, wherein the passage at the external circumferential side of the compression mechanism part is located at a position away from the discharge tube by degrees of one of 90 degrees and greater than 90 degrees of a phase angle along a direction of a circumference.

14. The compressor of claim 1, wherein a surface of the fan and an upper surface of a first balancer provided at the end of the rotor are located on one plane.

15. The compressor of claim 1, wherein the fan is fixed by a caulker with a first balancer provided at the end of the rotor, facing the first space.

16. The compressor of claim 1, wherein the passage at the external circumferential side of the compression mechanism part is located at a position away from the discharge tube by degrees of one of 90 degrees and greater than 90 degrees of a phase angle along a direction of a circumference.

* * * * *